United States Patent [19]

Leising et al.

[11] Patent Number: 4,822,977

[45] Date of Patent: Apr. 18, 1989

[54] PAPER TEMPERATURE MEASUREMENT FUSER CONTROL

[75] Inventors: Walter F. Leising, Webster; Michael Amato, Liverpool, both of N.Y.

[73] Assignee: Xerox Corporation, Stamford, Conn.

[21] Appl. No.: 39,846

[22] Filed: Apr. 20, 1987

[51] Int. Cl.[4] ..... H05B 1/02

[52] U.S. Cl. ..... 219/216; 355/3 FU; 219/388

[58] Field of Search ..... 219/216, 388; 355/3 FU, 355/14 FU

[56] References Cited

U.S. PATENT DOCUMENTS

| | | | |
|---|---|---|---|
| 3,851,144 | 11/1974 | Hutner | 219/216 |
| 4,078,166 | 3/1978 | Kitamura et al. | 219/216 |
| 4,104,692 | 8/1978 | Sudo et al. | 361/106 |
| 4,301,359 | 11/1981 | Ito et al. | 219/469 |
| 4,318,612 | 3/1982 | Brannan et al. | 355/14 |
| 4,367,037 | 1/1983 | Nishikawa | 355/14 FU |
| 4,672,177 | 6/1987 | Headrick | 219/216 |

FOREIGN PATENT DOCUMENTS

| | | | |
|---|---|---|---|
| 3517085 | 11/1985 | Fed. Rep. of Germany | 355/14 FU |
| 55-74572 | 6/1980 | Japan | 219/216 |

*Primary Examiner*—Teresa J. Walberg

*Attorney, Agent, or Firm*—Ronald F. Chapuran

[57] ABSTRACT

A fuser temperature control in a machine having a first temperature sensor contacting a fuser roll surface, a prefuser transport for conveying copy sheets to the fuser, a controller and a second sensor electrically connected to the first sensor and positioned adjacent the path of said copy sheets to sense the temperature of the copy sheets and the ambient temperature of the machine at the entry to the fuser, wherein the fuser roll temperature is controlled in response to variations in the ambient temperature at the pre-fuser transport and the temperature of the copy sheets.

9 Claims, 4 Drawing Sheets

PAPER TEMPERATURE MEASUREMENT FUSER CONTROL

This invention relates to a fuser for thermally fusing a copy sheet or like, and more particularly, to controlling the temperature of the fuser in response to the copy sheet and machine ambient temperature.

BACKGROUND OF THE INVENTION

The use of a dry, particulate toner heat fused to paper to form a permanent image on one or both sides of a copy sheet is well known in xerographic technology. A widely used heat fuser is a hot roller fuser. In this type of fuser, the sheet of paper to be fused passes through the pressure nip formed by two rollers which are in pressure contact. The quality of fusing produced by such a fuser is a function of temperature, time and pressure.

It is desirable to maintain the temperature in the fuser within a range optimal for fusing the toner transferred onto the copy sheet. For this purpose, temperature sensors and controllers have been used. For example, it is known to use a thermal couple directly on or in the vicinity of the heating element in the fuser to maintain the fuser temperature at this optimal point. In addition, U.S. Pat. No. 4,104,692 discloses a device for detecting abnormal temperature in a fuser. U.S. Pat. No. 4,318,612 discloses a control system which compares a command set point temperature to the fuser's actual temperature and energizes a fuser heater accordingly. A cold start of the fuser is distinguished from a warm start and the command set point temperature is magnitude-programmed accordingly. U.S. Pat. No. 4,301,359 discloses temperatures sensing elements for detecting the surface temperature of a heat roller and a control circuit which controls the conduction of the heating element in response to the output from the temperature sensing elements. U.S. Pat. No. 4,078,166 discloses a device for controlling the desired temperature detecting element in a fuser wherein the fuser means is heated to a temperature that allows fusing to be obtained, and then lowered after the copying operation of a few sheets of copy paper is finished. U.S. Pat. No. 3,851,144 discloses system for controlling fuser energization based upon the ambient temperature of the fuser.

There is a certain degree or latitude of the interface temperature between the toner and the paper to obtain suitable tonerpaper fusing. The toner-paper interface temperature is effected by many things such as different varieties of papers, ambient and environment temperature, the type of toner, and the basic fuser design. It is important to compensate for these differences to obtain the correct interface temperature. Adding new paper in the machine that is cooler will necessarily require an increase in the fuser temperature. Paper temperature and ambient environment temperature have important effects on the latitude of roll fusers. It has been determined that if the paper temperature and ambient temperature were well known, the correct toner-paper interface temperature could be more easily controlled. In general, the thermal mass of an internally heated fuser roller precludes response to direct real time sensing of the temperatures of individual sheets. That is, the fusing process speeds are too rapid (with respect to the fuser roll response capabilities) to allow fuser temperature control based on the temperature of each individual incoming copy sheet.

One alternative would be to use multiple sensors to sense both the temperature of the paper in the various paper trays and the temperature of various locations in the machine. This information could then be processed in a microprocessor or controller and used to provide control of fuser roll behavior during both machine run and machine standby. Unfortunately, this is an elaborate and expensive system. In addition to sensor costs, there are increased costs for microprocessor channels, sequencing and wiring. In addition, each sensor introduces some error and the effectiveness of the system is reduced.

A difficulty, therefore, with the prior art fuser temperature control systems has generally been complexity and cost. Furthermore, such systems have not always been accurate and reliable in accounting for the various temperature changes within the machine such as the ambient temperature and the change in temperature of the copy sheet upon which the toner is to be fused. Response to various temperature changes is important in order to continually provide the correct toner paper interface temperature.

It is an object of the present invention, therefore, to provide a new and improved fuser temperature control. It is another object of the present invention to provide a fuser temperature control that provides longer life, energy savings, and in particular maintains fuser offset latitudes, that is the correct toner/paper interface temperature. It is still another object of the present invention to provide a new and improved fuser control that senses both paper temperature and the machine ambient temperature when paper is not present at the sensor to maintain the correct fuser offset latitude.

Further advantages of the present invention will become apparent as the following description proceeds, and the features characterizing the invention will be pointed out with particularity in the claims annexed to and forming a part of this specification.

SUMMARY OF THE INVENTION

Briefly, the present invention is a fuser temperature control in a machine comprising a first temperature sensor contacting a fuser roll surface, a pre-fuser transport for conveying copy sheets to the fuser, a controller and a second sensor electrically connected to the first sensor and positioned adjacent the path of said copy sheets to sense the temperature of the copy sheets and the ambient temperature of the machine wherein the fuser roll temperature is controlled in response to variations in the ambient temperature at the pre-fuser transport and the temperature of the copy sheets.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
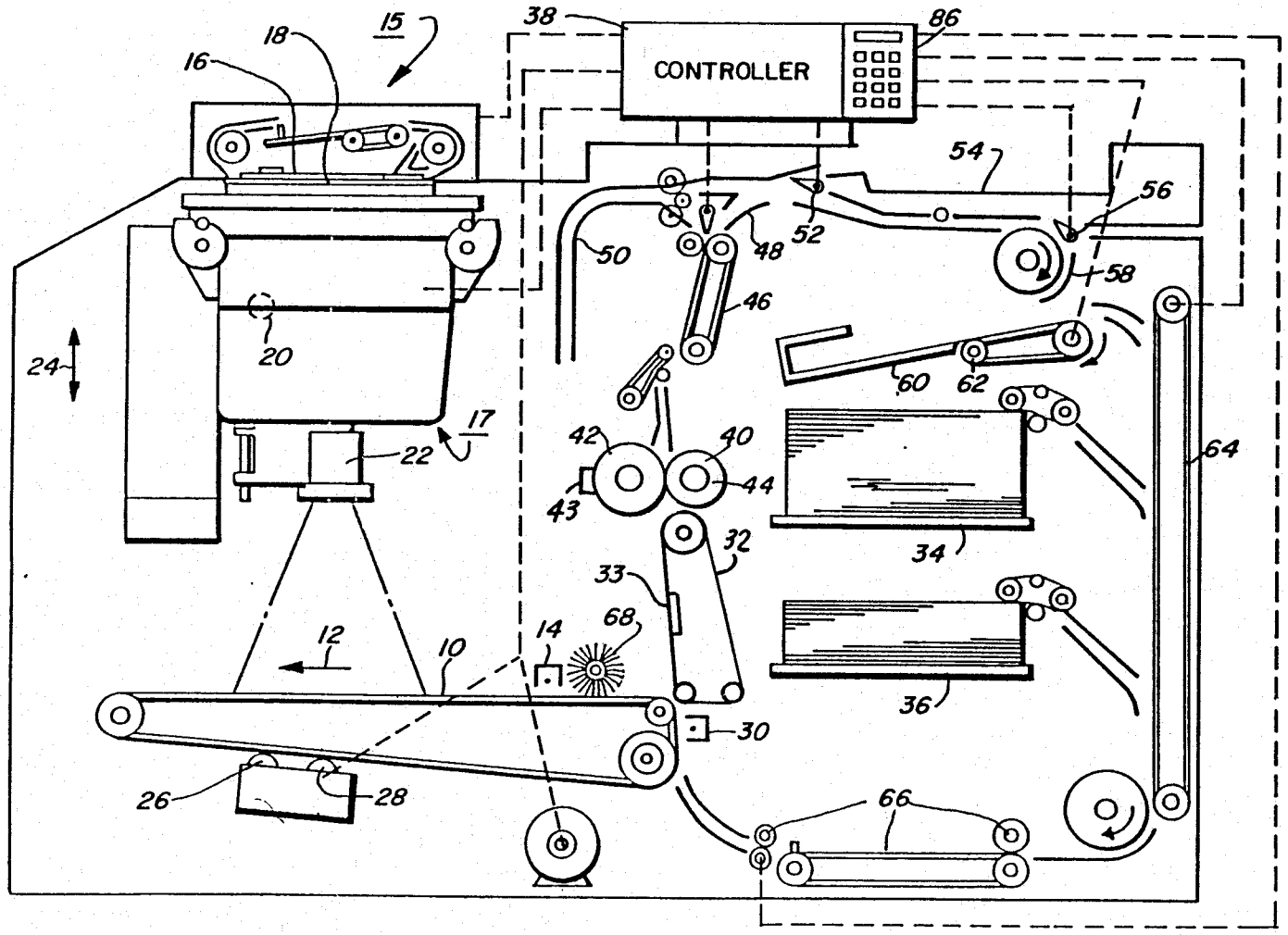
FIG. 1 is an elevational view of a reproduction machine having a fuser that can be controlled in accordance with the present invention

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with charging station including a corona generating device 14. The corona generating device charges the photoconductive surface to a relatively high substantially uniform potential.

The charged portion of the photoconductive surface is then advanced through an imaging station. At the imaging station, a document handling unit 15 positions an original document 16 face down over exposure system 17. The exposure system 17 includes lamp 20 illuminating the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge. This records an electrostatic latent image on the photoconductive surface corresponding to the informational areas contained within the original document.

Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 15 sequentially feeds documents from a holding tray, in seriatim, to platen 18. The document handling unit recirculates documents back to the stack supported on the tray. Thereafter, belt 10 advances the electrostatic latent image recorded on the photoconductive surface to a development station.

At the development station a pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. A the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 or 36 to the transfer station. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and back-up roller 44 with the sheet passing between fuser roller 42 and back-up roller 44 with the powder image contacting fuser roller 42. In accordance with the present invention, a pre-fuser transport sensor 33 is disposed at the pre-fuser transport 32 and a fuser roll sensor 43 is disposed at the fuser roll 42.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second gate 52. Decision gate 52 deflects the sheet directly into an output tray 54 or deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

Invariably, after the copy sheet is separated from the photoconductive surface of belt 10, some residual particles remain adhering to belt 10. These residual particles are removed from the photoconductive surface thereof at a cleaning station. The cleaning station includes a rotatably mounted brush 68 in contact with the photoconductive surface of belt 10.

Figure 2:
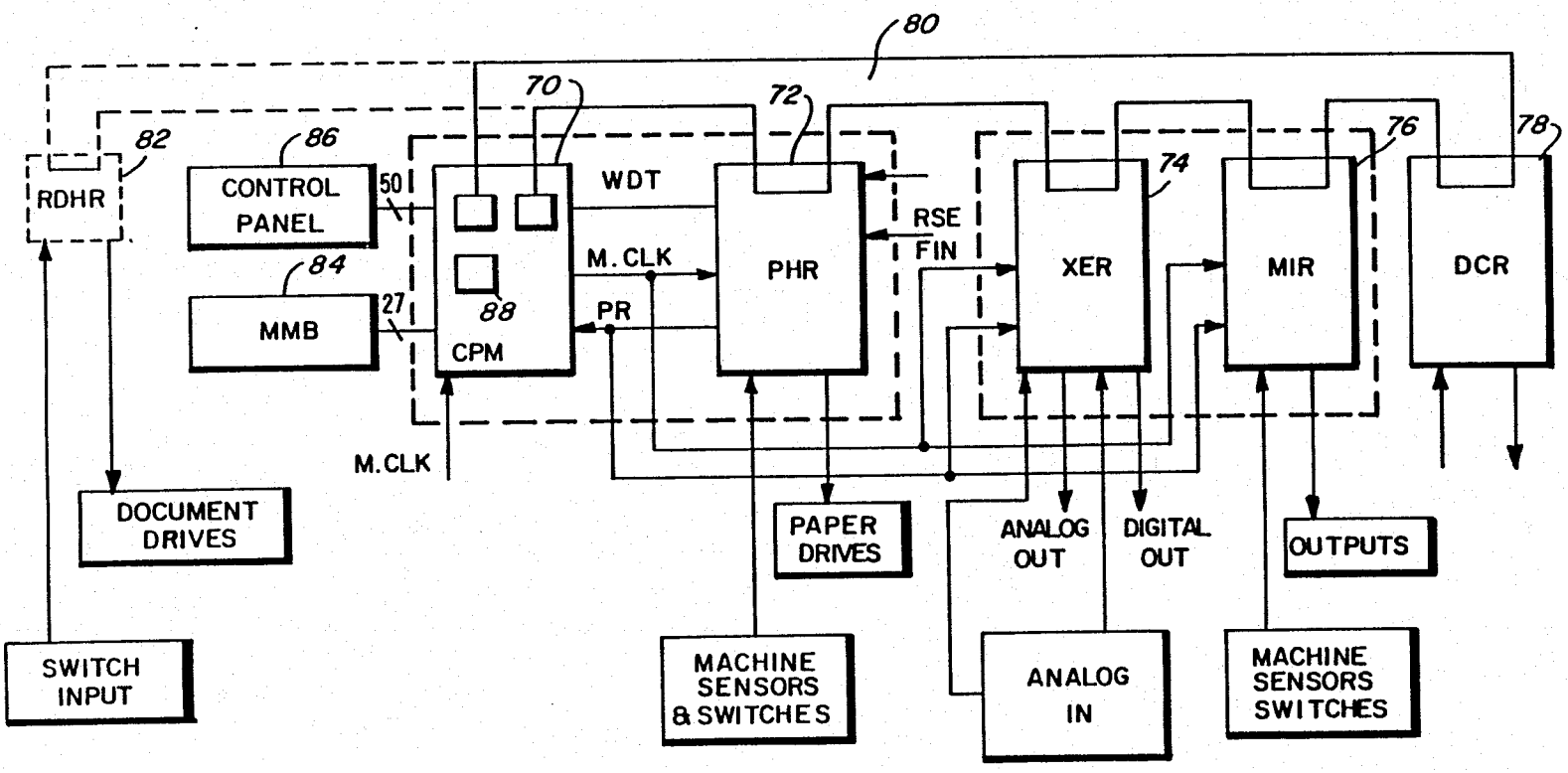
FIG. 2 is a block diagram of the control boards for controlling the machine of FIG. 1.

A controller 38 and control panel 86 are also illustrated in FIG. 1. The controller 38, as represented by dotted lines, is electrically connected to various components of the printing machine. With reference to FIG. 2, the is shown in further detail the controller 38 illustrated in FIG. 1. In particular, there is shown a Central Processing Master (CPM) control board 70 for communicating information to and from all the other control boards, in particular, the Paper Handling Remote (PHR) control board 72 controlling the operation of the paper handling subsystem such as paper feed, registration and output transport.

Other control boards are the Xerographic Remote (XER) control board 74 for monitoring and controlling the xerographic process, in particular the analog signals, the Marking and Imaging Remote (MIR) control board 76 for controlling the operation of the optics and xerographic subsystems, in particular, the digital signals. A Display Control Remote (DCR) control board 78 is also connected to the CPM control board 70 providing operation and diagnostic information on both an alphanumeric and liquid crystal display. Interconnecting the control boards is a shared communication line 80, preferably a shield coaxial cable or twisted pair with suitable communication protocol similar to that used in a Xerox Ethernet® type communication system.

Other control boards can be interconnected to the shared communication line 80 as required. For example, a Recirculating Document Handling Remote (RDHR) control board 82 (shown in phantom) can be provided to control the operation of a recirculating document handler. Thee can also be provided a not shown Semi-Automatic Document Handler Remote (SADHR) control board to control the operation of a semi-automatic document handler, one or more not shown Sorter Output Remote (SOR) control boards to control he operation of one or more sorters, and a not shown Finisher Output Remote (FOR) control board to control the operation of a stacker and stitcher.

Each of the controller boards preferably includes an Intel 8085 microprocessor with suitable Random Access Memory (RAM) and Read Only Memory(ROM). Also, interconnected to the CPM control board is a Master Memory Board (MMB) 84 with suitable ROMs to control normal machine operation and a control panel board 86 for entering job selections and diagnostic programs. Also, contained in the CPM board 70 is suitable nonvolatile memory. All of the control boards other than the CPM control board are generally referred to as remote control boards.

In a preferred embodiment,the control panel board 86 is directly connected to the CPM control board 70 and the memory board 84 is connected to the CPM control board 70. Preferably, the Master Memory Board 84 contains 56K byte memory and the CPM control board 70 includes 2K ROM, 6K RAM, and a 512 byte nonvolatile memory. The PHR control board 72 includes 1K RAM and 4K ROM and handles 29 inputs and 28 outputs. The XER control board 74 handles up to 24 analog inputs and provides 12 analog output signals and 8 digital output signals and includes 4K ROM and 1K RAM. The MIR board 76 handles 13 inputs and 17 outputs and has 4K ROM and 1K RAM.

As illustrated, the PHR, XER and MIR boards receive various switch and sensor information from the printing machine including the transport sensor 33 and fuser roll sensor 43 and provide various drive and activation signals, such as to clutches, motors, heating elements and lamps in the operation of the printing machine. It should be understood that the control of various types of machines and processes are contemplated within the scope of this invention.

Figure 3:
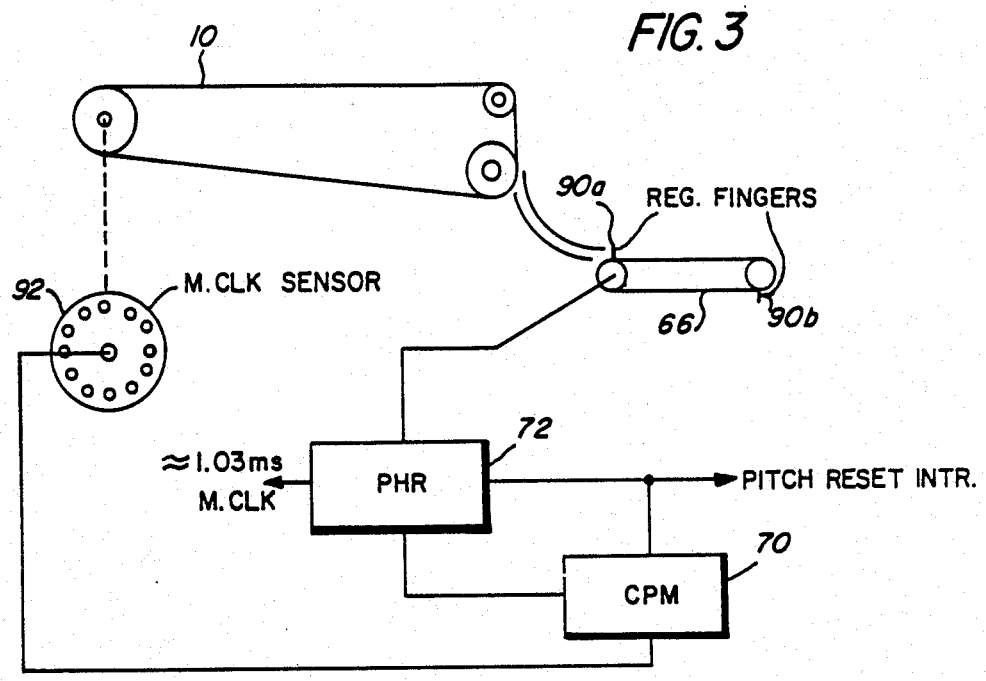
FIG. 3 illustrates some of the basic timing signals used in the control of the machine illustrated in FIG. 1.

A master timing signal, called the timing reset or Pitch Reset (PR) signal, as shown in FIG. 2, is generated by PHR board 72 and used by the CPM, PHR, MIR and XER control boards 70, 72, 74 and 76. With reference to FIG. 3, the Pitch Reset (PR) signal is generated in response to a sensed registration finger. Two registration Fingers 90a, 90b on conveyor or registration transport 66 activate a not shown suitable sensor to produce the registration finger or pitch reset signal. The registration finger or pitch reset signal is conveyed to suitable control logic on the Paper Handler Remote control board 72. In additional, a Machine Clock signal (MCLK) is conveyed to the Paper Handling Remote 72 via the CPM remote board 70 to the same control logic.

In response to the MCLK signal, the timing reset pitch reset signal is conveyed to the CPM board 70 and the XER and the MIR remotes 74, 76. The machine clock signal is generated by a timing disk 92 or machine clock sensor connected to the main drive of the machine. The clock sensor signal allows the remote control boards to receive actual machine speed timing information.

The timing disk 92 rotation generates 1,000 machine clock pulses every second. A registration finger sensed signal occurs once for every registration finger sensed signal as shown in FIG. 3. A belt hole pulse is also provided to synchronize the seam on the photoreceptor belt 10 with the transfer station to assure that images are not projected onto the seam of the photoreceptor belt.

Figure 4:
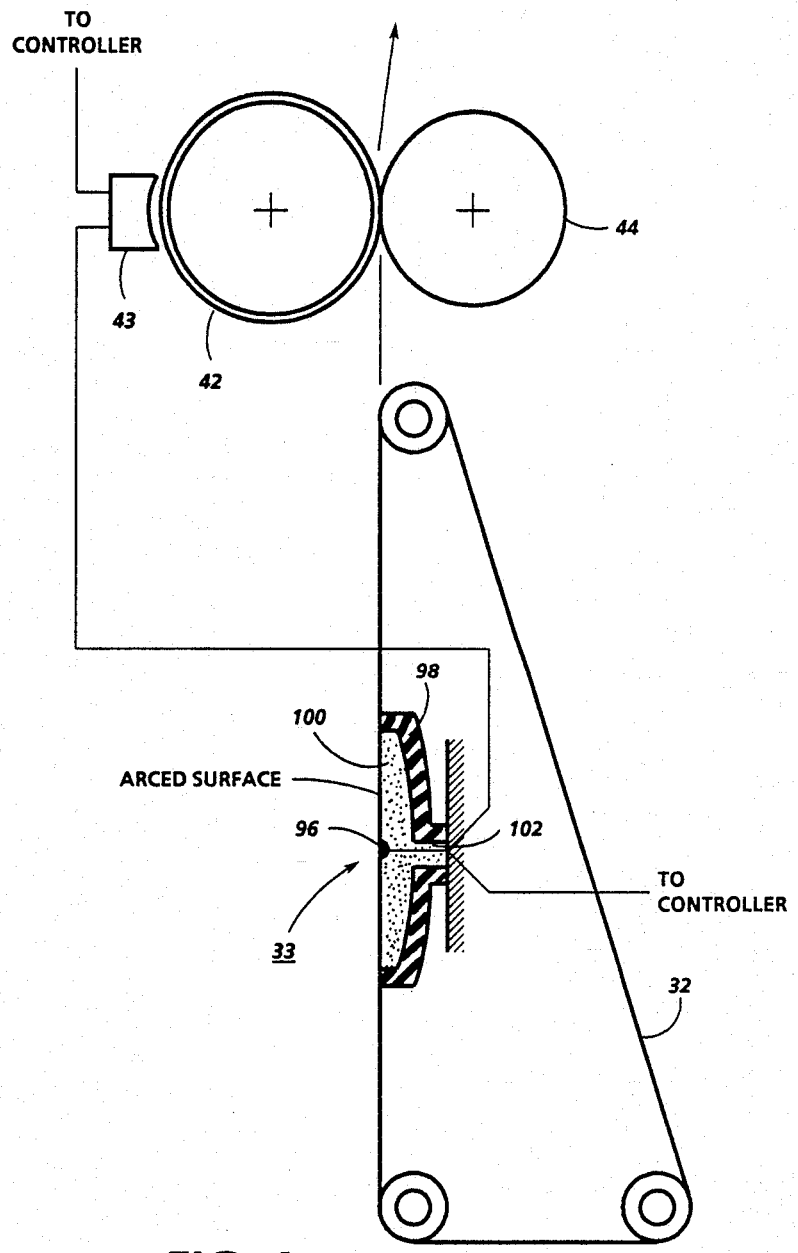
FIG. 4 is a detailed sketch illustrating a sensor at the fuser and a sensor at the pre-fuser transport in accordance with the present invention.

In accordance with the present invention, a single multi-purpose sensor 33 is located at the pre-fuser transport 32 or pre-fuser paper path as well as the fuser roll sensor 43 located at the fuser roll. With reference to FIG. 4, there is shown roll sensor 43 disposed adjacent the fuser roll 42 and the pre-fuser transport sensor 33 including a thermistor bead 96 disposed near the paper contact surface on the pre-fuser transport 32. As illustrated at 98, there is a relatively large surface area for the paper to contact the surface of the substrate 100 holding the thermistor 96. Preferably, the substrate providing the large surface area is plastic or any other suitable material with a metal surface for the paper contact and the metal surface would be slightly arced above belt profile to facilitate paper contact. There is also a relatively small area contact of the substrate with the pre-fuser transport chassis as illustrated at 102. As shown by arrows, the signals generated by the roll sensor 43 and the thermistor 96 are conveyed to the controller 38.

In a preferred embodiment, the sensor 33 would have the following features: in addition to the large area of contact with the paper and the small area of contact with the transport, the mass of the sensor would be tuned to give appropriate time constant, the sensor bead would be located in area dominated by paper contact, there would be separate input to controller, and as stated the paper contact area would be arced slightly above belt profile to facilitate paper contact.

The sensor system can be modeled as a lumped system having a total thermal mass Ms a thermal impedance to the copy sheet Rs, a thermal impedance to the air environment Re, and a thermal impedance to the transport Rt. Thus, the sensor has several inputs and these inputs can be tuned (as time constant in magnitudes) via the thermal mass Ms and thermal impedance values. In other words, the response of a thermistor which would result, ultimately, in fuser temperature control, could be governed by designating the thermal properties of the various structural components.

In a preferred embodiment, the sensor response time constant (Rc,Ms) would be tuned to be comparable but less than thermal response time of the fuser roll 42 during machine run. The thermal coupling of the sensor to the paper must dominate the coupling to the environment or transport. Then, $Rc << Re$. It is likely that the temperature in the region of the transport would be similar to the transport, especially during machine standby. It is also desirable to have the total thermal impedance less than or equal to the thermal impedance of the air environment $Rt \leqq Re$ because the transport has direct thermal contact with the copies and thus has a stronger thermal influence on the copy than does the air. Generally, thermal impedance of the copy is less than the thermal impedance of the transport which in turn is less than the thermal impedance of the environment, i.e. $Rc << Rt << Re$. This would be achieved by increasing the thermal contact of the sensor with the paper and decreasing the thermal contacts of the sensor with the transport. As shown, one method would be to have a much larger area of contact between the sensor and paper than between the sensor and the transport. The sensor bead 96 could also be located in a resistive path that is biased in favor of the copy. It should be noted that there are various alternatives and options available.

During standby, the transport would heat to the temperature of the surrounding environment. Thus, if the ambient temperature increased throughout the day, the transport temperature could be used as a signal and the fuser adjusted accordingly. Should the incoming copies be very cool, after twenty to thirty copies, the thermistor 96 would respond to the temperature via the sensor's metal plate conductor. This provides compensation during both standby and machine run.

It should be noted that there are also numerous electrical/logic options. For systems with processing capabilities, a separate input to the processor offers the most flexibility. It is also possible to place the sensor directly into the roll temperature sensor circuit and form a network. A simple and useful network would have the roll sensor and the auxiliary sensor in series. Both sensors have the same temperature-resistance direction, i.e. (if both have a negative slope or both have a positive slope) the compensation would be corrective. The precision and accuracy of the correction within the function of the overall design of the sensor and the properties of the sensor beads.

While there has been illustrated and described what is at present is considered to be a preferred embodiment of the present invention, it would be appreciated that numerous changes and modifications are likely to occur to those skilled in the art, and it is intended in the appended claims to cover all those changes and modifications which fall within the true spirit and scope of the present invention.

I claim:

1. A fuser device comprising:

a fuser roll having a fuser roll surface, a first temperature sensor contacting the fuser roll surface, a pre-fuser transport establishing a paper path between a paper storage device and the fuser roll surface for conveying copy sheets to the fuser roll, a controller, the first temperature sensor electrically connected to the controller, and a second sensor disposed in contact with the pre-fuser transport, the second sensor electrically connected to the controller and positioned adjacent the path of said copy sheets, the second sensor being in direct contact with a copy sheet in said paper path during transport of said copy sheet to the fuser, the fuser roll temperature being controlled in response to variations in the ambient temperature at the pre-fuser transport and the temperature of said copy sheets.

2. The control of claim 1 wherein said second sensor is a thermistor.

3. The control of claim 1 wherein said second sensor is supported by a substrate, a relatively large area of the substrate making contact with the copy sheets, a relatively small area of the substrate making contact with the pre-fuser transport.

4. Fuser apparatus for use in a reproduction machine for controlling the temperature interface between copy sheets and toner applied to the copy sheets as successive portions of a copy sheet are moved through said fuser apparatus, said apparatus comprising:

means in said fuser apparatus for applying heat energy, a pre-fuser transport establishing a paper path between a paper storage device and the fuser for conveying copy sheets to the fuser, a temperature sensor responsive to ambient machine temperature and the temperature of said copy sheets, and a substrate supporting the temperature sensor, a relatively large area of the substrate making direct contact with the copy sheets in said paper path, a relatively small area of the substrate making contact with the pre-fuser transport.

5. The apparatus of claim 4 wherein the relatively large area of the substrate is arced to facilitate paper contact.

6. The apparatus of claim 5 wherein said sensor is a thermistor bead.

7. A fuser device comprising:

having a fuser roll surface, a first temperature sensor contacting the fuser roll surface, a pre-fuser transport establishing a paper path between a paper storage device and the fuser roll surface for conveying copy sheets to the fuser roll, and a second sensor disposed in contact with the pre-fuser transport, the second sensor electrically connected to the first sensor and positioned in direct contact with the paper path of said copy sheets, the fuser roll temperature being controlled in response to variations in the ambient temperature at the pre-fuser transport and the temperature of said copy sheets.

8. The control of claim 7 wherein the second sensor is in contact with said copy sheets during transport of said copy sheets to the fuser.

9. The control of claim 7 wherein the first sensor is electrically connected in series with the second sensor.

* * * * *